US006155253A

United States Patent [19]

Gamberini

[11] Patent Number: 6,155,253

[45] Date of Patent: Dec. 5, 2000

[54] PROTECTION MASK, IN PARTICULAR FOR UNDERWATER USE

[75] Inventor: Guido Gamberini, Asti, Italy

[73] Assignee: Ocean Reef s.r.l., Genova, Italy

[21] Appl. No.: 09/008,106

[22] Filed: Jan. 16, 1998

[30] Foreign Application Priority Data

Jan. 16, 1997 [IT] Italy ..... MI97A0077

[51] Int. Cl.[7] ..... A62B 18/02

[52] U.S. Cl. ..... 128/201.18; 128/201.27

[58] Field of Search ..... 128/201.18, 201.27, 128/206.28, 206.21, 206.23, 201.19, 207.11, 206.24

[56] References Cited

U.S. PATENT DOCUMENTS

| | | | |
|---|---|---|---|
| 1,445,010 | 2/1923 | Feinberg | 128/201.18 |
| 2,693,799 | 11/1954 | Herman, Jr. | 128/201.18 |
| 2,974,665 | 3/1961 | Motsinger | 128/207.11 |
| 3,680,556 | 8/1972 | Morgan . | |
| 3,845,768 | 11/1974 | Garrahan . | |
| 4,250,877 | 2/1981 | Owens et al. | 128/207.11 |
| 4,440,165 | 4/1984 | Holzel | 128/201.18 |
| 4,449,546 | 5/1984 | Elam | 128/201.18 |
| 4,595,003 | 6/1986 | Shoemaker et al. . | |
| 4,736,740 | 4/1988 | Parker et al. | 128/201.19 |
| 4,756,308 | 7/1988 | Ryback | 128/201.19 |
| 5,481,763 | 1/1996 | Brostrom et al. | 128/207.11 |
| 5,524,300 | 6/1996 | Chiang | 2/439 |
| 5,572,990 | 11/1996 | Berlin | 128/201.19 |
| 5,595,174 | 1/1997 | Gwaltney | 128/201.15 |
| 5,645,046 | 7/1997 | Kay | 128/201.18 |
| 5,845,637 | 12/1998 | Knott | 128/207.12 |
| 6,008,780 | 12/1999 | Clarke et al. | 345/8 |

FOREIGN PATENT DOCUMENTS

| | | | |
|---|---|---|---|
| 0686408 | 12/1995 | European Pat. Off. . | |
| 669841 | 1/1939 | Germany | 128/201.18 |
| 2047545 | 12/1980 | United Kingdom . | |

OTHER PUBLICATIONS

European Search Report, The Hague, Sep. 30, 1999, Examiner De Sena Hernand . . , A.

Patent Abtracts of Japan, vol. 199, No. 610, Oct. 31, 1996, Kamiya Shigeki

*Primary Examiner*—John G. Weiss
*Assistant Examiner*—Teena Mitchell
*Attorney, Agent, or Firm*—Hedman, Gibson & Costigan

[57] ABSTRACT

The main purpose of the invention is to enable protective masks commonly known as "large face shield" masks to be used in a variable pressure environment, and in particular under water. The mask (1) internally comprises a pair of parallel protuberances (34) extending below the user's nose and having dimensions such as to be able to hermetically close the user's two nostrils simultaneously when applied to said nostrils by a movement from the bottom upwards. Said movement is allowed by the deformability of the gasket (4) which provides the hermetic seal between the edge (17) of the face shield (2) and the user's face.

4 Claims, 6 Drawing Sheets

14
16
17
18
21
2
20
19
"α"
4
7
1
28
29
5
34
33
26
23
30
22
6
25

PROTECTION MASK, IN PARTICULAR FOR UNDERWATER USE

BACKGROUND OF THE INVENTION

This invention relates to a protection mask, in particular for underwater use.

As is well known, the normal underwater masks essentially comprise an optical surface provided with a rubber-coated rim which seals against the user's face and extends sufficiently to contain the nose, without however preventing it from being squeezed between the fingers to close it hermetically, so as to enable the user to effect the necessary compensation as the depth of immersion changes. In this respect, compensation is an essential operation for adequately counter-balancing the external pressure to prevent collapse of the eardrum. Although the aforesaid masks are reliable and are commonly used, they present drawbacks which are well known to the expert and will therefore be only briefly mentioned.

To breath in and out, the user has to hold in his mouth (retaining it between his teeth) a nozzle, upstream of which there is provided a feeder (low pressure reducer), the mass of which is large as it consists of inoxidizable metal re resist corrosion. Respiration through the mouth is not natural and the discomfort deriving therefrom is further intensified in that cylinder air is much drier than atmospheric air. The mouth engages in this manner cannot be used to activate other instruments, for example to voice-activate the remote voice transmission instruments. The protection offered by such masks against water, against cold and against the effects of pressure is limited to the few covered parts. The seal which such masks offer of often more theoretical than practical in that the mask gaskets are required to perform the difficult task of sealing against those regions of the face which are extremely special both for their delicacy, for their very variable shape from person to person, and for their mobility (facial action is very intense).

To solve the aforesaid drawbacks, consideration could be given to using masks having a face shield covering the entire face. For example consideration could be given to using (after suitably adapting the connectors for the respiration devices) the protective masks described in U.S. Pat. No. 5,080,092 and IT 1 215 684, but currently this is not possible mainly because such masks (commonly known as "large face shield" masks because they cover the entire face of the user) prevent access to the nose for the compensation operation. The use, under variable pressure conditions, of masks which do not allow this compensation clearly lead to eardrum rupture.

The object of this invention is therefore to obviate the aforesaid drawbacks by providing a "large face shield" mask which enables compensation operations to be effected, while being able to be used under variable external pressure and in particular in an underwater environment.

Using a mask of the invention, ie a "large face shield" mask, which at the same time enables the compensation operations to be effected results in the overcoming of all the problems which afflict current underwater masks and which have merely been summarized heretofore in that they are numerous and are well known to the expert of the art in addition to all who practice underwater activity.

These objects are attained by an underwater mask in accordance with claim 1, to which reference should be made be brevity. During normal use the means for compensating the pressure within the ear duct, and comprising at least one protuberance, can be positioned below the user's nostrils so as not to hinder free air inflow and outflow. When compensation becomes necessary, by utilizing the elasticity and deformability of the seal gasket the face shield is suitably moved relative to the user's face so that said at least one protuberance is rested against the user's nostrils by a movement from the bottom upwards relative to the user's face, so as to seal them hermetically and allow compensation. It is important to note that the invention is based mainly on the intuition that to effect compensation it is not essential to squeeze the nose (an operation which is sometimes painful because of the presence of mucous within the nostrils and in any event always annoying and irritating for the nose) but is also possible by simple closure achieved by barring the nostril holes from the outside. The method by which closure is achieved by simple barring, ie by applying occluding bodies from the bottom upwards to the nostrils, is inventive in that it is contrary to the teaching of closing the nostrils by squeezing, which has always been accepted as the most natural, and hence unquestioned in the art. Consequently the invention goes against the technical prejudgements of the art in that in the underwater sector it has never been considered that the simple application of occluding bodies to the nostrils could achieve a sufficiently valid closure for the compensation operations to be adequately effected. A mask of "large face shield" type can therefore be used in the presence of pressure variations and in particular under water, with the following further advantages:

The user can breathe in and out in a natural manner, ie mainly through the nose and if necessary also through the mouth in the case of breathlessness. Mucous material in the throat is no longer subject to drying by the effect of the dry air fed in, because the nose is able to compensate in a natural manner for ny decreased air humidity.

The mouth is freed of the nozzle, and the jaws are no longer burdened by the weight of the feeder and nozzle and hence the mask can be worn for several hours without excessively tiring these body parts.

The feeder and nozzle weight are supported by the face shield and are transmitted to the user's face by the seal gasket which by resting on a very wide and regular portion of the face can create an excellent seal without excessive pressure. Possible further devices (such as a phonic device) can therefore be applied to the face shield without any problem.

The feeder feeds air into the mask such that the pressure within the mask is equal or proportional to the external pressure. By suitably adjusting the device for evacuating the air breathed out by the user, the pressure within the mask can be maintained within a range of optimum values for the gasket seal and for user comfort. This avoids the annoying and sometimes painful phenomenon of the mask squeezing against the user's face when the external pressure increases.

If, notwithstanding all this, water should manage to penetrate into the mask, it is necessary merely to adjust the feeder so that it feeds an additional air flow at a pressure sufficiently higher than the external pressure such that the water which penetrates is expelled through the device for evacuating the air breathed out by the user, together with the additional air. In traditional underwater masks this is not possible because the feeder feeds directly into the user's mouth, and devices for evacuating the air breathed out by the user are not provided.

As the mouth is no longer engaged to retain the nozzle, it can be used to speak in a natural manner and hence for communication if the mask is also provided with voice remote transmission means. The mask of the invention can be modified for communication with all the advantages deriving therefrom.

By isolating the forehead, the eyes, the nose, the mouth and the chin from the external environment, the mask of the invention offers effective protection for these parts of the body against cold, against water, against salinity, and against possible contaminant substances dissolved in the water. In this respect, such effective protection is unattainable with traditional underwater masks, which are substantially limited to covering and hence protecting only the eyes and nose.

By acting on a tendentially large surface, the seal gasket provides excellent sealing without generating lines or reddening on the skin in those regions on which it rests.

The protective mask of the invention can also be used in variable pressure environments other than underwater, for instance at high altitude where compensation is necessary and where it would be very advantageous to use "large face shield" masks because of their good protection characteristics. From the aforegoing it is also apparent that the mask of the invention can also be used without problems as a terrestrial protective masks. As the mask of the invention can be used in water, on the ground and at high altitude, it has a flexibility of use such that the number of models can be reduced, to the extent of making it particularly economical and attractive to the market, especially the military market which with a single mask could cover all requirements.

One embodiment of the mask of the invention is described hereinafter by way of non-limiting example with reference to the accompanying figures. The described embodiment relates in particular to a protective mask for underwater use.

DETAILED DESCRIPTION OF THE INVENTION

Figure 1:
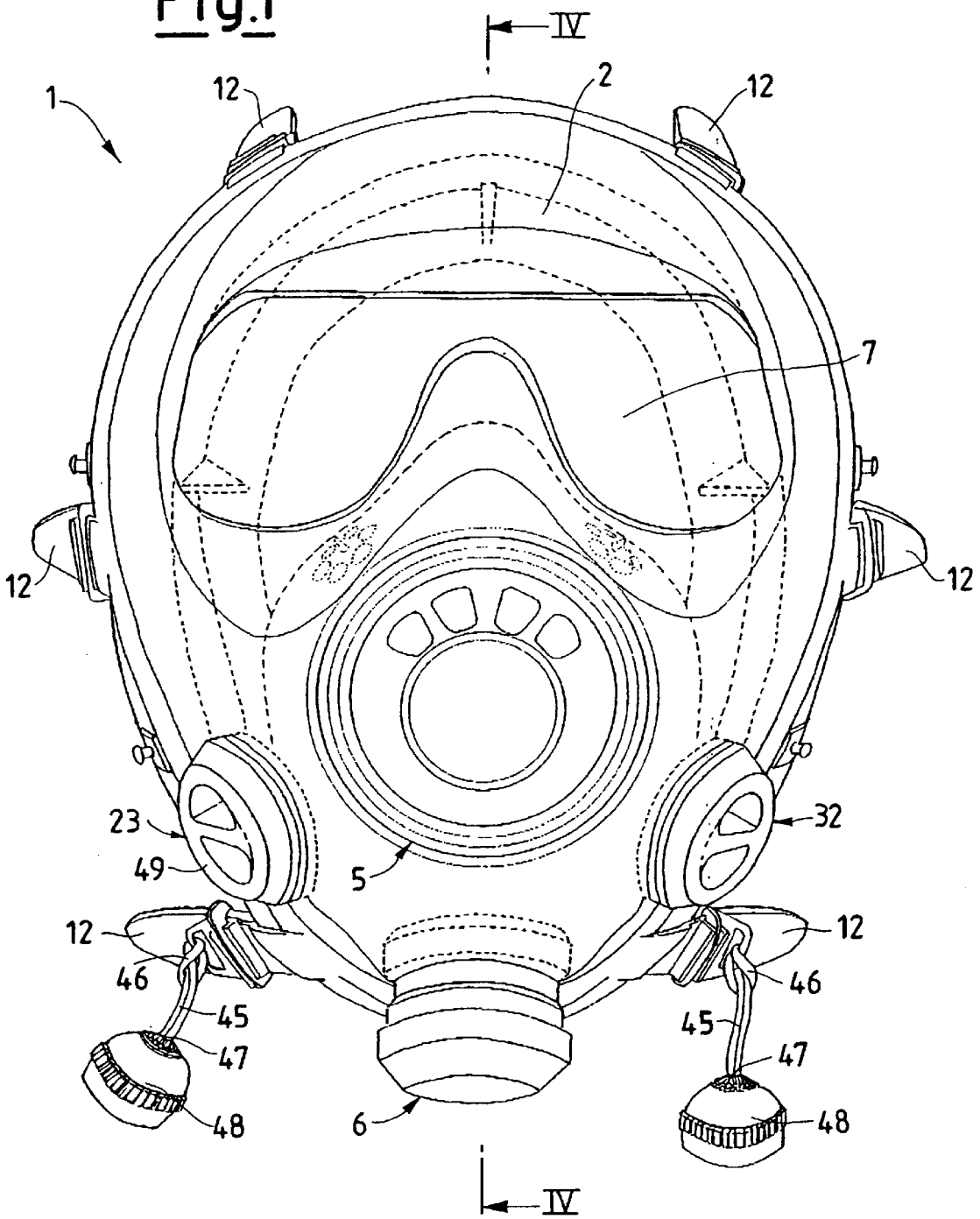
FIG. 1 is a front elevation of a mask according to the invention.
Figure 2:
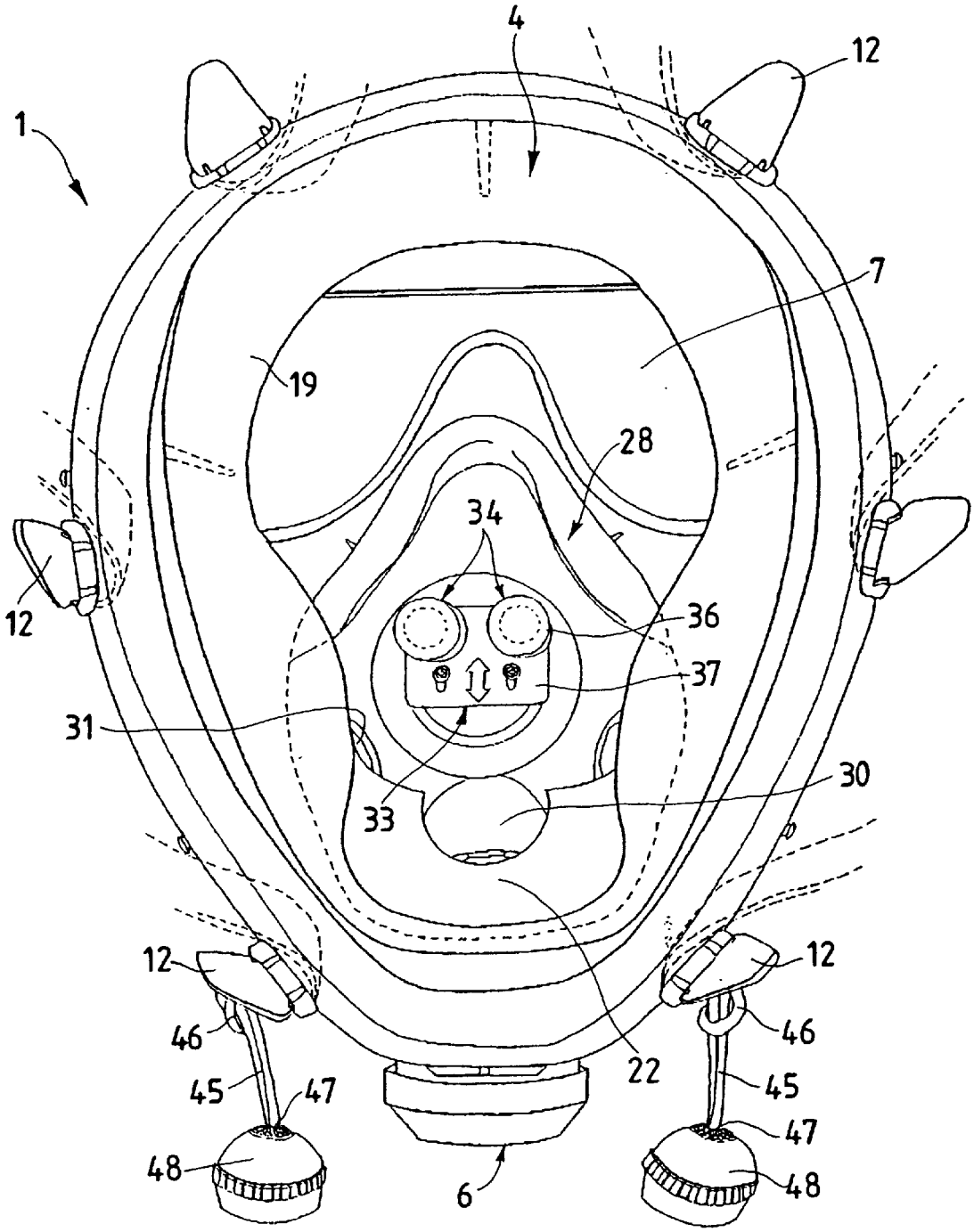
FIG. 2 is a rear elevation in which the straps are shown removed for clarity.
Figure 3:
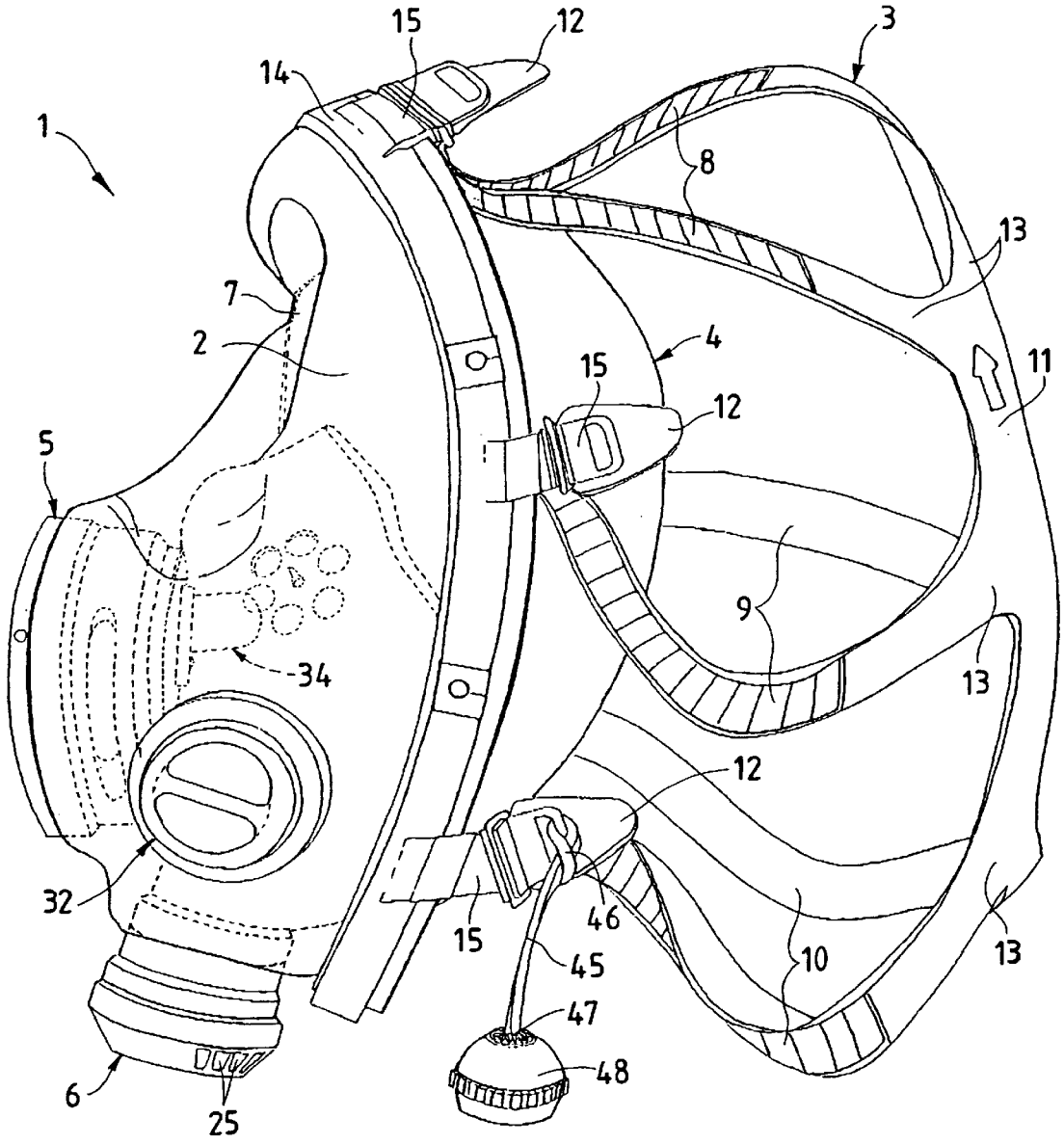
FIG. 3 is a side elevation.
Figure 4:
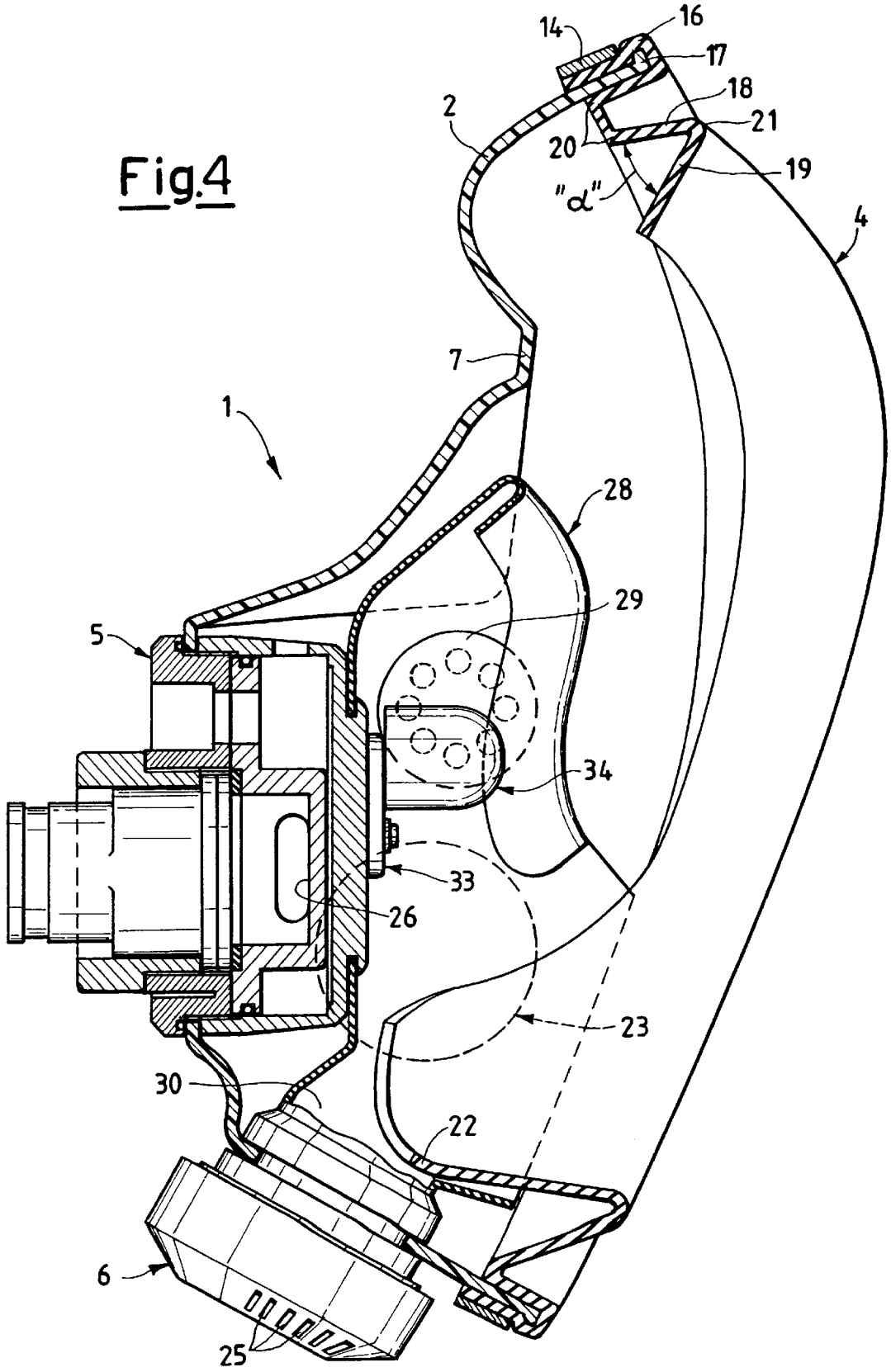
FIG. 4 is a section on the line IV—IV of FIG. 1.
Figure 5:
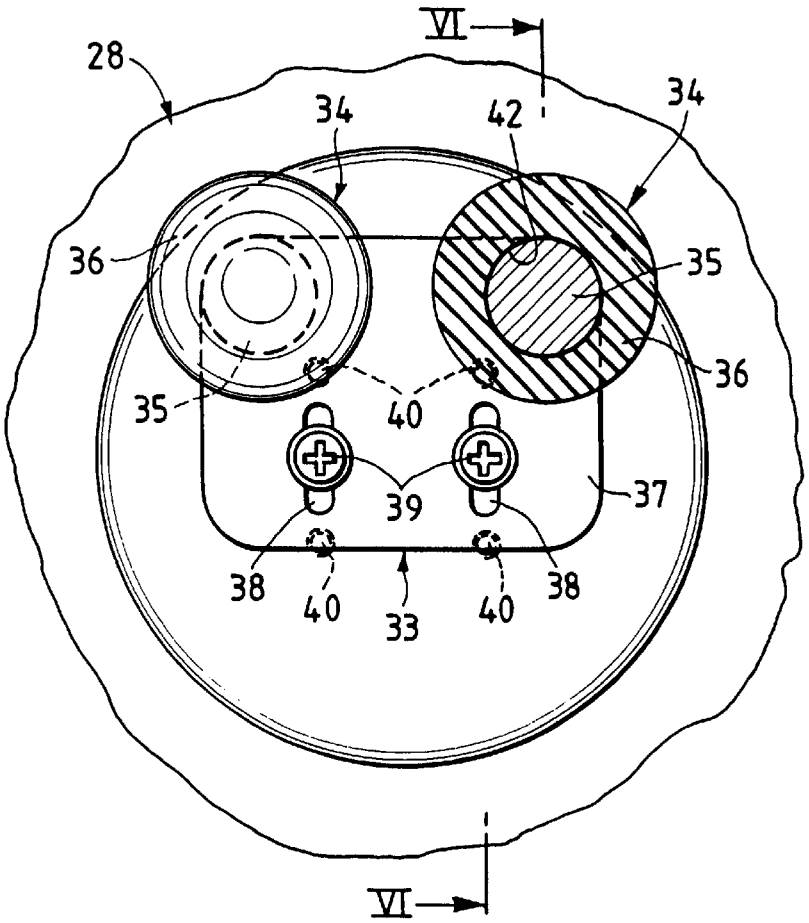
FIG. 5 is an enlarged detail of the means for compensating the pressure within the ear duct.
Figure 6:
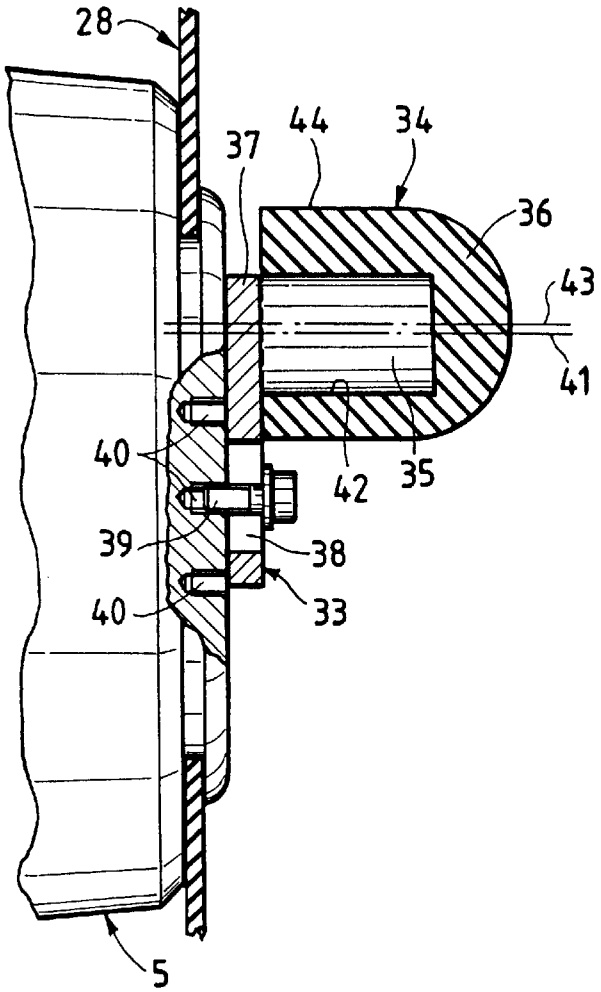
FIG. 6 is a section on the line VI—VI of FIG. 5.
Figure 7:
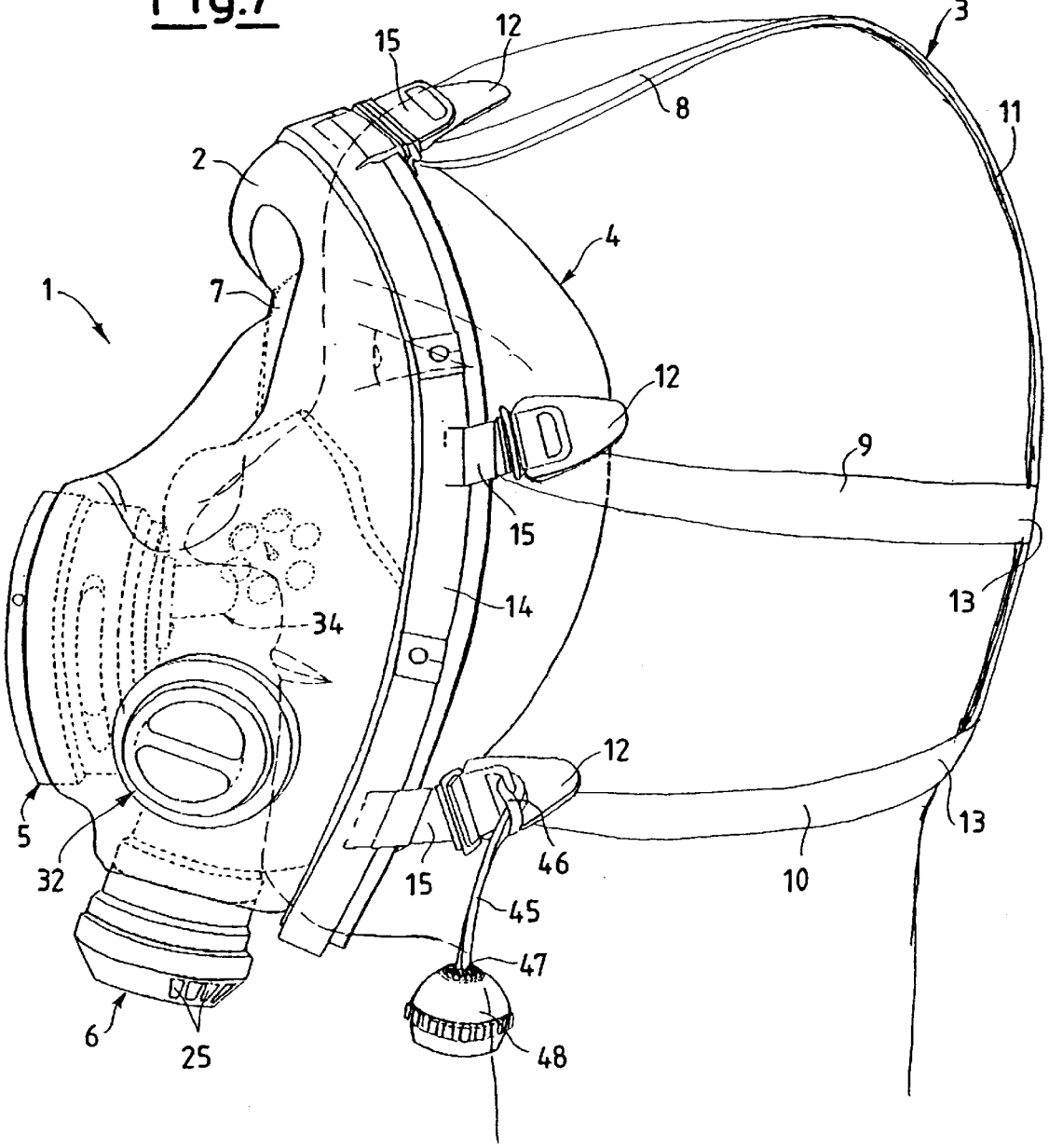
FIG. 7 is a schematic illustration of the mask as worn by a user.

The mask of the invention, shown in the aforesaid figures and indicated overall by 1, is a protective mask particularly for underwater use. It comprises substantially: a face shield 2, means 3 for securing the mask 2 to the face of a user, a gasket 4, a device 5 for feeding the air to be breathed by the user, and a device 6 for evacuating the air breathed in by the user.

The face shield is of rigid material and totally or partially transparent. Polycarbonate is the preferred material as it represents the best compromise between the various technical requirements (weight, transparency, workability) and cost. The dimensions of the face shield 2 are such as to protect the user's forehead, eyes, nose, mouth and chin. The face shield 2 has a transparent portion shaped to constitute an optical surface 7. The optical surface 7 is a flat surface in the shape of a pair of spectacle lenses of the most transparent material possible, and is arranged on the face shield 2 such that, when the mask is worn, the optical surface is perpendicular to the optical axes of the user's pupil.

In the illustrated example, the means 3 for securing the mask 1 to the user's face comprise two upper straps 8, two middle straps 9 and two lower straps 10, and a central connection portion 11. The first ends 12 are connected to the rigid face shield 2 by a band 14 which secures the seal gasket 4 to the face shield 2. The second ends 13 are connected to the portion 11. The straps 8–10 and the central connection portion 11 form a "spider structure" which when the mask is mounted lies against the naps of the user's neck. The first ends 12 of the straps 8–10 are operationally associated with length adjustment means 15 positioned on the band 14.

The gasket 4 for forming the hermetic seal between the edge 17 of the face shield 2 and the user's face is of elastic material with a substantially bellows structure, of such rigidity that with the mask 1 mounted the face shield 2 is movable (floatable) relative to the user's face. Said bellows comprises an element 16 fixable to the edge 17 of the face shield 2, and at least one first and one second annular concentric lip, 18, 19 respectively. The element 16 can be tightened by the band 14 and is connected along a first hinge line 20 to said first lip 18. The first lip 18 is joined on one side to the element 16 and on the remaining side to the second lip 19 along a second hinge line 21. During use, the second lip 19 abuts against the user's face. The second lip 19 comprises a portion 22 for at least partially containing the user's chin. The first lip 18 and second lip 19 diverge at a concave angle $\alpha$, said concavity facing the face shield 2. The angle $\alpha$ is of substantially constant size along the entire length of the edge 17 of the face shield 2. Further information regarding the gasket 4 can be obtained from EP-A-0 303 090.

In the illustrated example, the mask 1 comprises, positioned on the face shield 2, two devices for feeding the air to be breathed by the user. A first (or main) device 5 is positioned to the front at the level of the user's mouth, a second or auxiliary device 23 being positioned laterally. In the illustrated example, the second device 23 is positioned on the right side of the face shield and hence of the user.

As can be seen in the figures, said devices 5 and 23 are provided with a thread or bayonet connector for the application of ring nut for fixing a nozzle or alternatively a plug 49. To enable the two devices 5 and 23 to be alternatively used also when immersed, they each comprise a valve (not shown) which automatically closes hermetically when the air source is not connected.

The devices 5 and 23 are provided with respective inner ports 26 and 27 (this latter not visible) which open into the space existing between the inner surface of the face shield 2 and the outer surface of an oronasal maskpiece 28. The oronasal maskpiece 28 extends to cover the nose, mouth and chin of the user by passing below the seal gasket 4. The oronasal maskpiece 28 comprises at least one unidirectional hydraulic valve 29, a first port 30 and a second port 31. In the illustrated example two unidirectional hydraulic valves 29 are provided, enabling fluids to pass only from the outside to the inside of the oronasal maskpiece 28. The valves 29 are positioned one on each side of the user's nose. The first port 30 allows fluids to pass towards the device 6 for evacuating the air breathed out by the user, the second port 31 allowing the voice to pass towards the phonic communication means 32.

The device 6 for evacuating the air breathed out by the user is positioned on the face shield 2 below the user's chin. It comprises essentially a unidirectional hydraulic valve (not shown) enabling fluids to flow only towards from the interior of the mask 1. The outlet ports 25 of the valve 24 are positionable to direct the outflow away from the visual field and in particular from the optical surface 7.

Within the mask, means 33 are provided to compensate the internal pressure within the ear duct. The means 33 comprises within the mask at least one protuberance extending towards and below the user's nose, and of such dimensions as to hermetically and simultaneously close the two nostrils of the user by application to the nostril exterior. This application is achieved by moving said at least one protuberance from the bottom upwards, this movement being allowed by the elastic deformability of the gasket 4 which provides the hermetic seal between the edge 17 of the face shield 2 and the user's face. The position on the face shield 2 of the ear duct internal pressure compensation means 33 can be adjusted, to compensate the position of the user's nose, in two perpendicular directions, ie from the top downwards and from the outside inwards. In the illustrated example regarding an underwater mask, the ear duct internal pressure compensation means 33 comprise a preferably cylindrical protuberance 34 for each nostril. The two protuberances 34 comprise a pair of pegs 35 on which a pair of anallergic silicone rubber plugs 36 are applied, positionable at will along said paid of pegs 35. The axis 41 of the inner hole 42 of each plug 36 is parallel to but not coincident with the axis 43 of the outer cylindrical surface 44 of each plug 36. The two pegs 35 have one end secured to a plate 37 positionable vertically at will relative to the face shield 2. As can be seen, the plate 37 is provided with slots 38 engaged by screws 39 which fix it to the body 5 of the face shield 2. Each screw 39 can engage a plurality of vertically aligned nuts 40. The combination of the slots 38 and nuts 40 and the fact that the axes 41 and 43 do not coincide allow continuous vertical adjustment of the position of the plate 37, of the protuberances 34 and of the plugs 36. Continuous horizontal adjustment of the position of the plugs 36 is provided by their ability to slide along the axes 41 and 43 on the pegs 35. Said adjustments enable the means 33 to be easily adapted to each user.

In the illustrated mask 1, the phonic communication means 32 are applied to the face shield 2. Said means can be of passive type (ie comprise a phonic membrane which transmits the user's voice to the outside), or of active type (for example of ultrasonic type powered by an external energy source).

The mask 1 comprises a pair of laces 45 the first ends 46 of which are secured directly or indirectly to the face 2 (preferably to the band 14) at points opposite the chin, the second ends 47 being provided with handgrip or knob 48 for easy gripping. By pulling these outwards from the face, the mask is immediately removed from the user's head without effort, however well it is secured.

The mask 1 can be easily put on by inserting the head between the two lower straps 10. By using the means 15, the seal gasket 4 is loaded sufficiently to enable it to operate correctly. The means 15 enable each strap 8–10 to be tensioned to the appropriate extent, and possibly differently from the other straps 8–10. The particular structure of the gasket in combination with the straps and the adjustment means 15 enables a single gasket 4, ie the mask 1 itself, to be adapted to almost all faces of Indo-European type without it being necessary to use different sizes. This fact allows a substantial reduction in the number of sizes, resulting in considerable economical advantages in that both the mask and the spares stocks to be held are considerably reduced. During breathing, the air to be breathed penetrates into the mask through the device 5 to leave from the ports 26, then before entering the oronasal maskpiece 28 via the valve 29 it grazes the interior of the face shield and in particular the optical surface 7, hence demisting it if necessary. The air which has been breathed out is blocked within the oronasal maskpiece by the valves 29 and can escape from the mask only through the evacuation device 6 by opening the hydraulic valve 24, which being unidirectional always prevents fluids entering from the outside. It is important to note that the air to be breathed never mixes with the air already breathed, and that this latter, being able to leave the oronasal maskpiece 28 only through the valve 24, never reaches the face shield which therefore always remains perfectly demisted and clean, to always allow optimum viewing.

This separation also means that the air breathed is always free of carbon dioxide, which consequently does not stagnate within the mask. The internal pressure within the mask is substantially equal to the external pressure in that the air to be breathed is fed into the mask from the outside. Consequently the face shield or gasket are never squeezed by pressure excessively against the user's face, who consequently does not tire and is not marked.

The pressure with which the gasket adheres to the face remains substantially at is initial value and as it is distributed over a tendentially large surface (comprising the forehead, the eyes, the mouth and the chin) the mask is very comfortable. If water should however infiltrate, it accumulates by gravity above the evacuation device 6. To expel it, it is necessary merely to introduce into the mask an additional air flow to open the valve 24 and hence expel both the water and the excess air. To compensate this, it is sufficient to lightly press the gasket at the forehead. By operating in this manner the protuberances 34 occlude the user's nostrils so that he can effect compression. on releasing the mask the protuberances 34 become positioned below the nostrils so leaving them free.

The communication means 32 can be active or passive and can be also positioned frontally.

The mask evacuation device 6 can also be connected to a closed circuit apparatus (rebreather).

What is claimed is:

1. A protective mask (1) particularly for underwater use comprising:

a face shield (2) of rigid material, of such dimensions as to protect the user's forehead, eyes, nose, mouth and chin, and having at least one portion shaped to form an optical surface (7);

means (8–11) for securing the mask to the user's face;

a gasket (4) of elastic material for hermetic sealing between an edge (17) of the face shield (2) and the user's face;

at least one device (5, 23) for introducing the air to be breathed by the user;

a device (6) for evacuating the air breathed out by the user; characterized by comprising within the interior of the mask, means for ear duct internal pressure compensation (33) comprising within the mask at least two protuberances (34) having dimensions which allow the protuberances to hermetically close the user's two nostrils simultaneously by its application to the exterior of the nostrils by moving said at least two protuberances (34) upwardly, this movement being allowed by the elastic deformability of the gasket (4) which provides the hermetic seal between said edge (17) of the face shield (20) and the user's face, said two protuberances comprising a pair of pegs (35) on which a pair of plugs (36) of anallergic silicone rubber are applied, which are positionable at will along said pair of pegs (35).

2. A mask as claimed in claim 1, characterized in having an internal hole (42) wherein the axis (41) of said internal hole 42 of each plug (36) is parallel to but not coincident with the axis (43) of an outer cylindrical surface (44) of the pair of plugs (36).

3. A mask as claimed in claim 1, characterized in that the two pegs (35) have one end secured to a plate (37) positionable vertically at will relative to the face shield (2).

4. A mask as claimed in claim 7, characterized in that the plate (37) is provided with slots (38) engaged by screws (39) which fix it to the face shield (2), each screw (39) being able to engage a plurality of vertically aligned nuts (40).

* * * * *